US006357749B1

(12) United States Patent
Feola

(10) Patent No.: US 6,357,749 B1
(45) **Date of Patent: *Mar. 19, 2002**

(54) MULTIPLE ROUND CARD GAME OF CHANCE

(76) Inventor: John Feola, 42 Irving St., Medford, MA (US) 02155

( * ) Notice: Subject to any disclaimer, the term of this patent is extended or adjusted under 35 U.S.C. 154(b) by 0 days.

This patent is subject to a terminal disclaimer.

(21) Appl. No.: 09/540,315

(22) Filed: Mar. 31, 2000

Related U.S. Application Data

(63) Continuation-in-part of application No. 09/312,562, filed on May 14, 1999.

(51) Int. Cl.[7] ..... A63F 1/00
(52) U.S. Cl. ..... 273/292; 273/274
(58) Field of Search ..... 273/269, 292, 273/236, 274, 303; 463/11–13

(56) References Cited

U.S. PATENT DOCUMENTS 1,616,884 A * 12/1927 Bosley et al.
4,560,171 A * 12/1985 Anthony
5,918,884 A * 7/1999 DiMuro
5,957,774 A * 9/1999 Holmes et al.
6,149,156 A * 11/2000 Feola

* cited by examiner

*Primary Examiner*—Benjamin H. Layno
*Assistant Examiner*—Vishu K Mendiratta
(74) *Attorney, Agent, or Firm*—Morse, Altman & Martin

(57) ABSTRACT

A card game having multiple rounds in which a player chooses which rounds to play and a number of cards for each round on a display. Each round has rules different from the other rounds. Cards and their values are randomly selected and revealed. Payouts are determined by the number of player-chosen cards that matches the number of randomly selected cards and/or by the hand formed by the randomly selected values revealed for the player-chosen cards.

22 Claims, 13 Drawing Sheets

COMBINATION GAME

$ JACKPOT AMOUNT

| Guaranteed Five | Five Card Match | Seven Card Match | Guaranteed Seven |
|---|---|---|---|
| Royal Flush $20,000 | Royal Flush % | Royal Flush % | Royal Flush $2,500 |
| Straight Flush 2,000 | Straight Flush % | Straight Flush % | Straight Flush 300 |
| Four of a Kind 100 | Four of a Kind % | Four of a Kind % | Four of a Kind 100 |
| Full House 50 | Full House % | Full House % | Full House 10 |
| Flush 25 | Flush % | Flush % | Flush 5 |
| Straight 15 | Straight xx | Straight xx | Straight 3 |
| Three of a Kind 10 | Three of a Kind xx | Three of a Kind xx | Three of a Kind 2 |
| Two Pair 4 | Two Pair xx | Two Pair xx | Two Pair 1 |
| One Pair 1 | One Pair xx | One Pair xx | One Pair 0 |

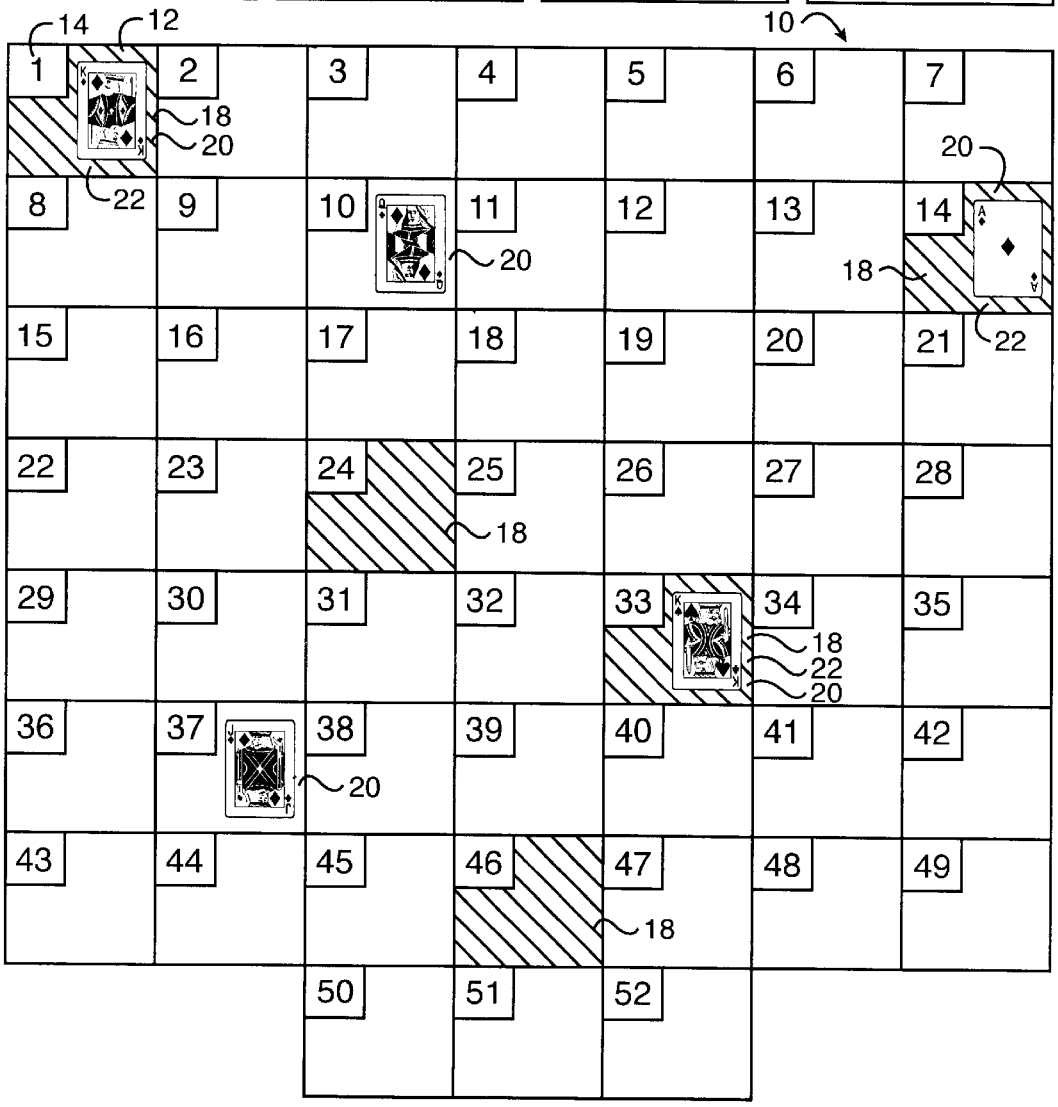

FIG. 2

COMBINATION GAME

$ JACKPOT AMOUNT

| Guaranteed Five | Five Card Match | Seven Card Match | Guaranteed Seven |
|---|---|---|---|
| Royal Flush $20,000 | Royal Flush % | Royal Flush % | Royal Flush $2,500 |
| Straight Flush 2,000 | Straight Flush % | Straight Flush % | Straight Flush 300 |
| Four of a Kind 100 | Four of a Kind % | Four of a Kind % | Four of a Kind 100 |
| Full House 50 | Full House % | Full House % | Full House 10 |
| Flush 25 | Flush % | Flush % | Flush 5 |
| Straight 15 | Straight xx | Straight xx | Straight 3 |
| Three of a Kind 10 | Three of a Kind xx | Three of a Kind xx | Three of a Kind 2 |
| Two Pair 4 | Two Pair xx | Two Pair xx | Two Pair 1 |
| One Pair 1 | One Pair xx | One Pair xx | One Pair 0 |

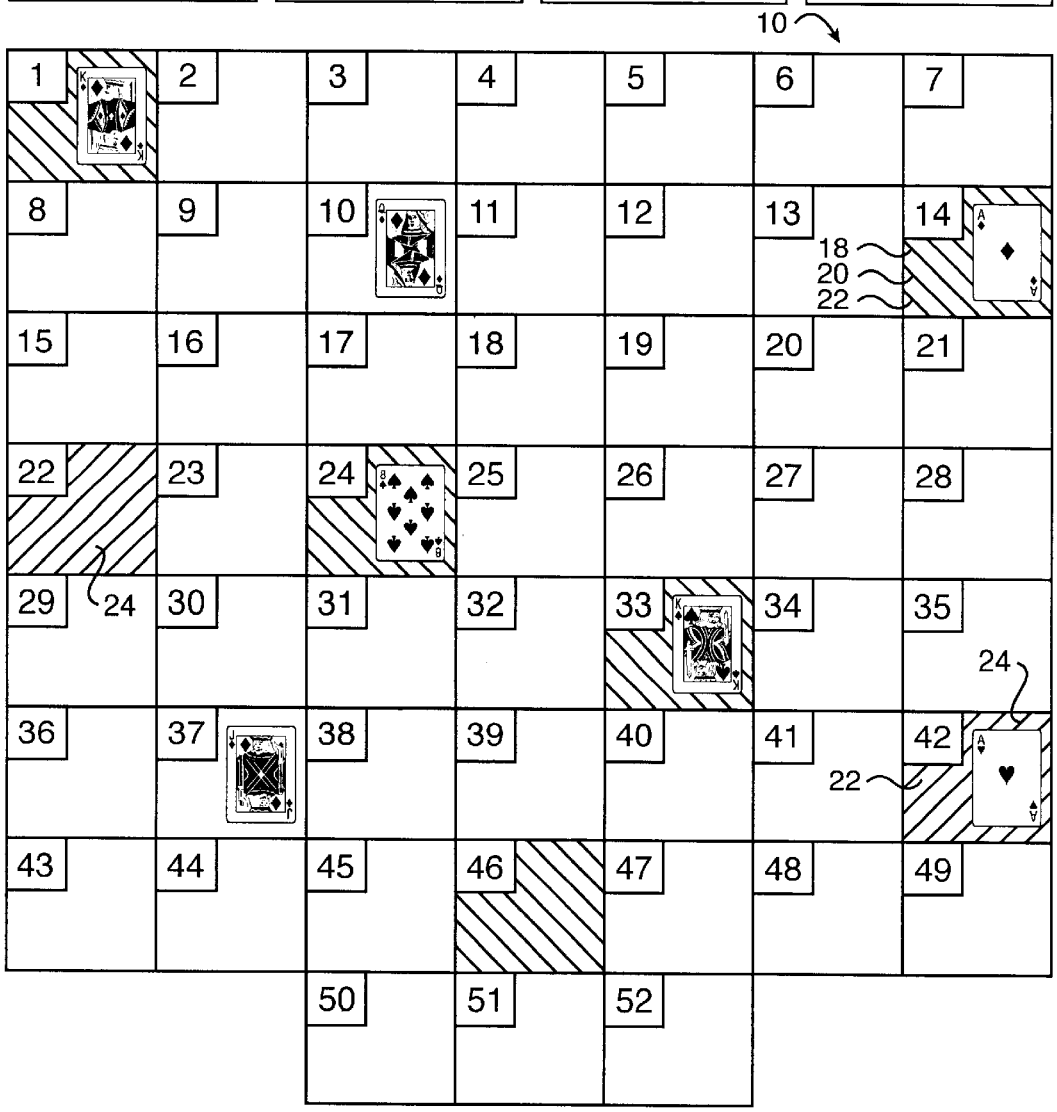

FIG. 6

COMBINATION GAME

$ JACKPOT AMOUNT

| Guaranteed Five | Five Card Match | Seven Card Match | Guaranteed Seven |
|---|---|---|---|
| Royal Flush $20,000 | Royal Flush % | Royal Flush % | Royal Flush $2,500 |
| Straight Flush 2,000 | Straight Flush % | Straight Flush % | Straight Flush 300 |
| Four of a Kind 100 | Four of a Kind % | Four of a Kind % | Four of a Kind 100 |
| Full House 50 | Full House % | Full House % | Full House 10 |
| Flush 25 | Flush % | Flush % | Flush 5 |
| Straight 15 | Straight xx | Straight xx | Straight 3 |
| Three of a Kind 10 | Three of a Kind xx | Three of a Kind xx | Three of a Kind 2 |
| Two Pair 4 | Two Pair xx | Two Pair xx | Two Pair 1 |
| One Pair 1 | One Pair xx | One Pair xx | One Pair 0 |

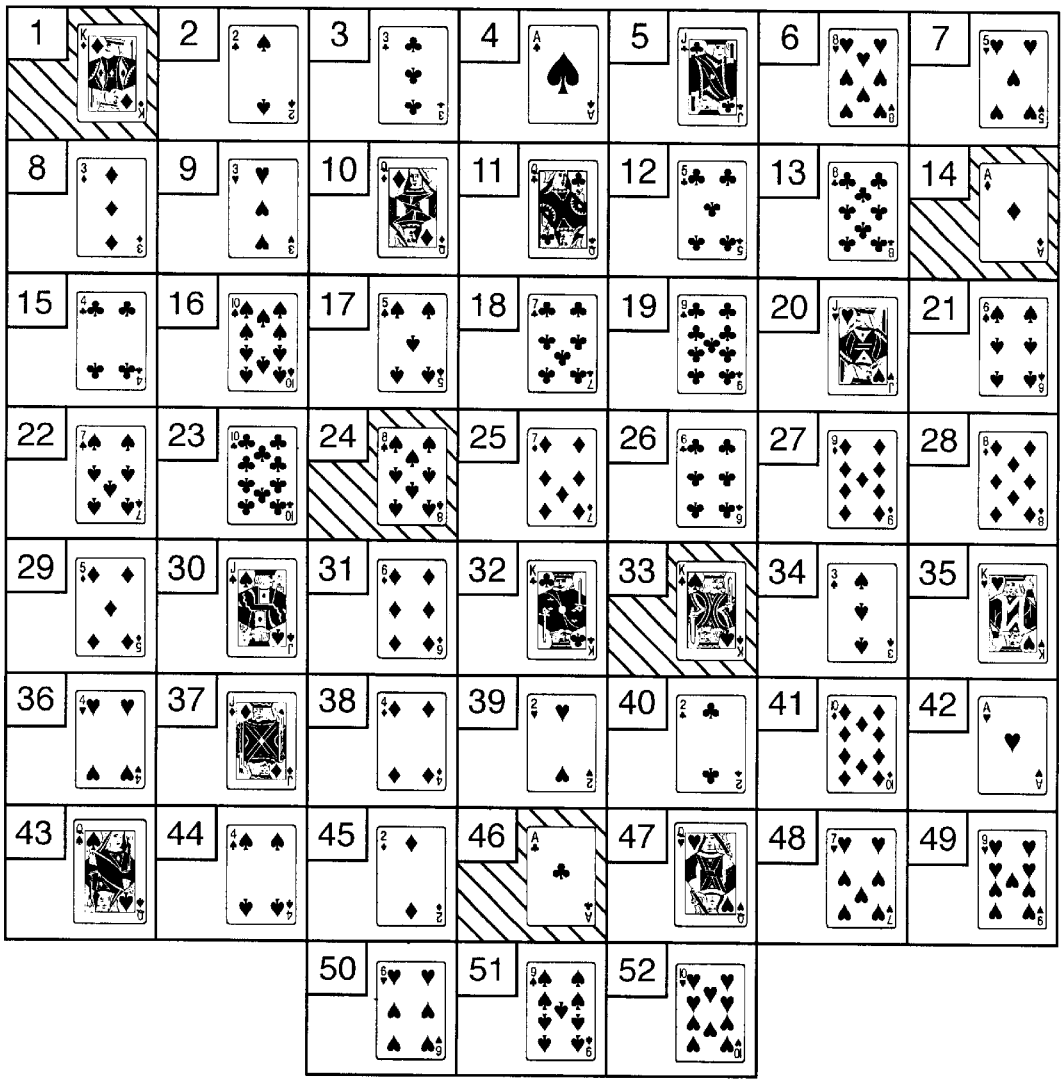

FIG. 7

COMBINATION GAME

$ JACKPOT AMOUNT

| Guaranteed Five | Five Card Match | Seven Card Match | Guaranteed Seven |
|---|---|---|---|
| Royal Flush $20,000 | Royal Flush % | Royal Flush % | Royal Flush $2,500 |
| Straight Flush 2,000 | Straight Flush % | Straight Flush % | Straight Flush 300 |
| Four of a Kind 100 | Four of a Kind % | Four of a Kind % | Four of a Kind 100 |
| Full House 50 | Full House % | Full House % | Full House 10 |
| Flush 25 | Flush % | Flush % | Flush 5 |
| Straight 15 | Straight xx | Straight xx | Straight 3 |
| Three of a Kind 10 | Three of a Kind xx | Three of a Kind xx | Three of a Kind 2 |
| Two Pair 4 | Two Pair xx | Two Pair xx | Two Pair 1 |
| One Pair 1 | One Pair xx | One Pair xx | One Pair 0 |

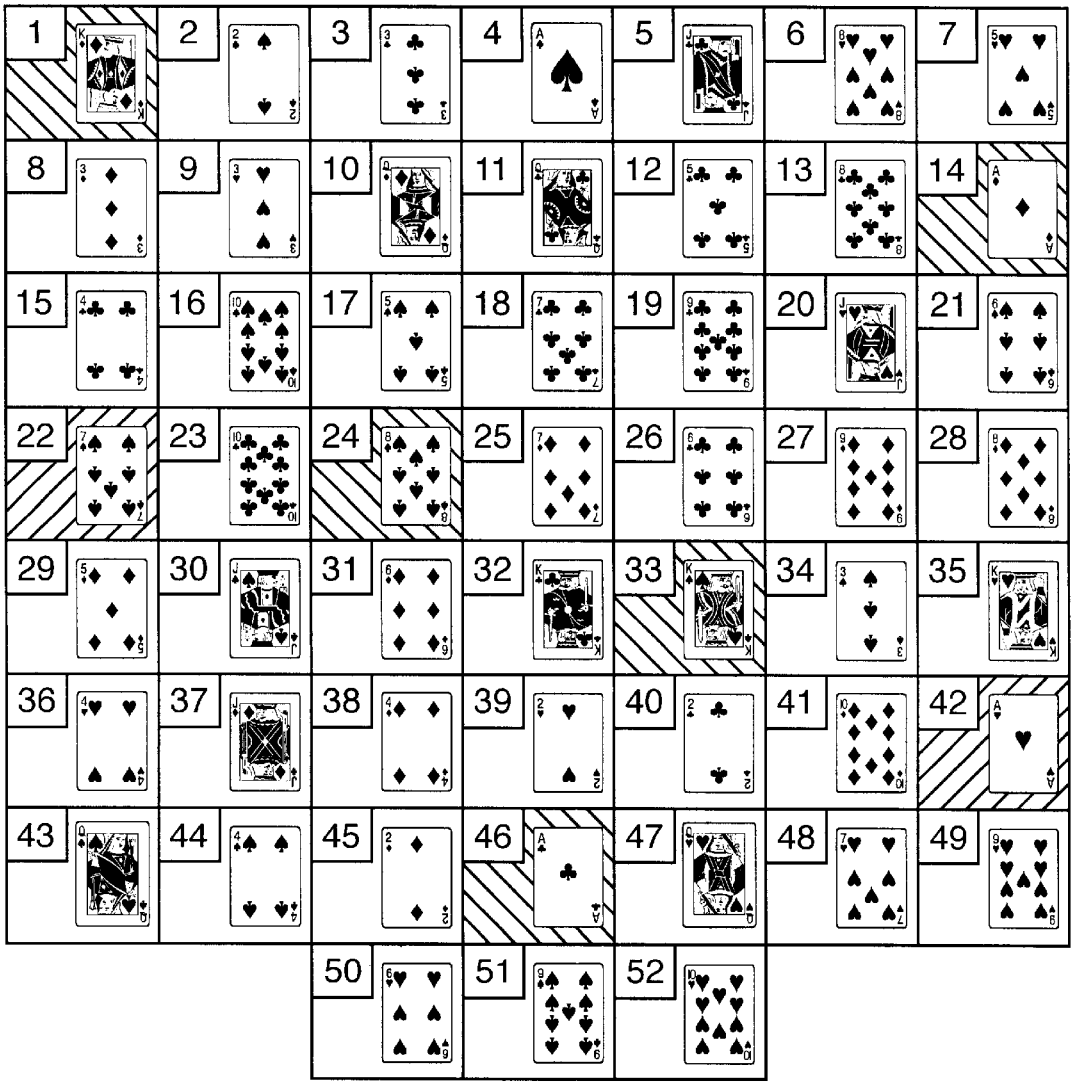

FIG. 9

COMBINATION GAME

| Five Location Match Round # 01000 | | 5-of-7 Location Match Round # 01000 | | Guaranteed Five Round # 01000 | | Guaranteed Seven Round # 01000 | |
|---|---|---|---|---|---|---|---|
| $ | Select "5" Numbers | $ | Select "7" Numbers | $ | Select "5" Numbers | $ | Select "7" Numbers |
| 1 | 4 8 12 16 20 | 1 | 4 8 12 16 20 31 42 | 5 | 4 8 12 16 20 | 1 | 4 8 12 16 20 31 42 |
| 1 | 3 7 25 30 41 | 1 | 3 7 25 30 41 49 52 | 10 | 3 7 25 30 41 | 4 | 3 7 25 30 41 49 52 |
| 1 | 2 14 29 44 52 | 1 | 7 9 13 17 27 41 46 | 5 | 2 5 9 17 20 | 10 | 7 8 9 24 31 41 46 |
| 1 | 8 18 28 38 48 | 1 | 2 5 11 21 34 39 45 | 1 | 16 22 32 45 52 | 2 | 6 8 9 15 17 21 40 |
| 1 | 9 13 22 25 47 | 1 | 4 9 12 26 28 31 43 | 2 | 7 12 17 33 50 | 5 | 2 6 7 12 13 18 24 |
| 2 | 1 7 10 15 20 | 2 | 1 4 10 18 25 30 52 | 3 | 13 14 22 41 51 | 3 | 1 4 8 17 35 42 52 |

FIG. 13

42

MULTIPLE ROUND CARD GAME OF CHANCE

RELATED APPLICATIONS

The present application is a continuation-in-part application of application Ser. No. 09/312,562, filed May 14, 1999 for MULTIPLE ROUND CARD GAME OF CHANCE in the name of John Feola.

BACKGROUND OF THE INVENTION

1. Field of the Invention

The present invention relates to games of chance, more specifically, to a card game that allows a player to play more than one individual card game in a progression.

2. The Prior Art

There are a number of non-casino games of chance where winners and losers are determined immediately or almost immediately after the wager is made. Such games include scratch tickets, pull-tab tickets, and keno. With scratch and pull-tab tickets, the player buys the ticket and either scratches spots or opens tabs according to the instructions for the ticket. The player knows immediately whether she is a winner or not. However, the player has little choice in what locations to scratch or open. For example, if the game being played is poker-based, the player will not be able to choose from all of the possible 52 cards because there is limited space on the ticket. This means that tickets are predetermined to be winners or losers.

Probability tickets are different in that every ticket has the potential to be a winner. There are a number of spots to scratch and the player chooses some of them, as indicated by the rules. However, the player still does not have a choice of all 52 cards.

In keno, the player chooses numbers up to a maximum, for example, choosing 10 numbers between 1 and 80. The more numbers that are matched, the greater the payout. Variations include allowing the player to select a variable number of numbers, for example, between 1 and 15 number. When run by a state, the winning numbers are drawn periodically during the day, such as every 15 minutes, and players who have chosen their numbers prior to the drawing participate. Players find out quickly whether they win or lose and then the cycle starts over again. The excitement of playing the game is short-lived and is not drawn out over an extended period.

SUMMARY OF THE INVENTION

An object of the present invention is to provide a game that has more than one round of different card games.

Another object is to provide a card game in which winners are determined at the end of each round of the game so that the excitement of the game is drawn out over an extended period.

A further object is to provide a card game that includes more than one round that can be played individually.

A still further object is to provide a multiple round card game in which there is the potential to win every round of every game.

The basis of the game of the present invention is that a player chooses a number of cards from a set of cards and uses the randomly-selected values later revealed for these chosen cards to play a number of different individual games, or rounds, where a wager may be placed on each round. A game has at least two rounds, and a player may play one or more, but there is no requirement that the player play an earlier round to play a later round. Having multiple rounds provides more excitement since, even if a player loses earlier rounds, she can still win later rounds, which will typically have better odds.

In some rounds, the number of player-chosen cards that match the number of randomly selected cards determines the payout, and in some rounds, the hand formed by the randomly selected values revealed for the player-chosen cards determines the payout. The payouts are generally determined by the odds of getting a particular hand.

The player chooses cards for each round from a display of a set of unique symbols, a symbol for each card of the set from which the predetermined number of cards are chosen. The display may take the form of a grid of locations, where each location represents a card. How the player chooses the rounds and locations and how the grid is displayed depends upon the medium on which the game is played. Having a the ability to select from all cards in play means that the player has the potential to win every game, which is unlike other games that preselect a subset of the total number of possible cards for the player to choose from.

One embodiment of the game includes four rounds: (1) a five card match game, (2) a seven card match game, (3) a guaranteed five card hand game, and (4) a guaranteed seven card hand game. The following describes each game as if it is played by itself. The goal of the five card match game is for the player to choose the five cards that will be randomly selected and revealed. The player chooses five cards and the controller randomly selects five cards and values for the cards. Payouts are made based on the number of matched cards, which are those cards that are the same as player-chosen cards, and/or payouts are made based on the hand formed from the values of the matched cards. The seven card match game is similar to the five card match game, except that the player chooses seven cards and the controller selects seven cards and values for those seven cards.

The goal of the guaranteed five card hand game is for the player to choose five cards to form a hand that is listed on the payout schedule. The player chooses five cards and the controller randomly selects values for at least the five chosen cards. A hand is formed from the values of the chosen cards and payouts are based on whether or not the hand is list in the payout schedule. In one embodiment, the player must use the five cards chosen. In another embodiment, the player is allowed to reject chosen cards and choose others to total five cards. The guaranteed seven card hand game is similar to the guaranteed five card hand game, except that the player chooses seven cards instead of five.

In one embodiment of the game of the present invention, the above-described individual games are combined as rounds into a single combination game. First, the player chooses which rounds she will participate in, which cards to play for each round, and the amount to wager for each chosen round. Then the five card match game is initiated by revealing five randomly selected cards and the randomly selected values for those cards. Matched cards and the hands formed from the matched cards are determined. Payouts are either made at this time or held until the end of the combination game. Next, the seven card match game is initiated by randomly selecting two additional cards and their values. Matched cards and the hands formed from the matched cards are determined. The two additional cards plus the five selected cards from the five card match game are the seven cards used to determine matched cards.

Next, the guaranteed five card hand game is initiated by revealing the values for the first five chosen cards, which are carried over from the first round. Finally, the guaranteed seven card hand game is played. The chosen cards and selected values carry over to this round. Then payouts that have not yet been made are made.

In one embodiment of the combination game, the appropriate values are revealed at the beginning of each round, in progression as each game is played. In another embodiment, all of the values are revealed at the same time. The first embodiment provides more suspense as the game is extended over a longer period of time. The second embodiment permits more games to be played in a given period of time.

The present invention contemplates that the game may be played on a variety of media, including scratch or pull-tab tickets and electronic media, such as public and private video systems, and stand-alone machines, such as personal computers and hand held game machines. With scratch tickets, the card values are randomly selected prior to printing, and the player makes her choices by scratching the chosen cards in a grid. In public video systems, players typically make their choices by marking slips of paper or by keys or touch screens at a location remote from the controller. The grid is displayed on a public video screen or matrix of video screens visible to the players at the remote location. With private standalone machines, the grid is displayed on the player's private video screen and the player's choices are made using keys or a touch screen.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein:

FIG. 2 is a drawing of the display of FIG. 1 showing five cards chosen by a player and five cards selected by the controller;

FIG. 6 is an example of the seven card match game of the display of FIG. 1;

FIG. 7 is an example of the guaranteed five card hand game of the display of FIG. 1;

FIG. 9 is an example grid of the guaranteed seven card hand game;

FIG. 13 is an example of another slip for choosing individual games and cards.

DETAILED DESCRIPTION

Figure 1:
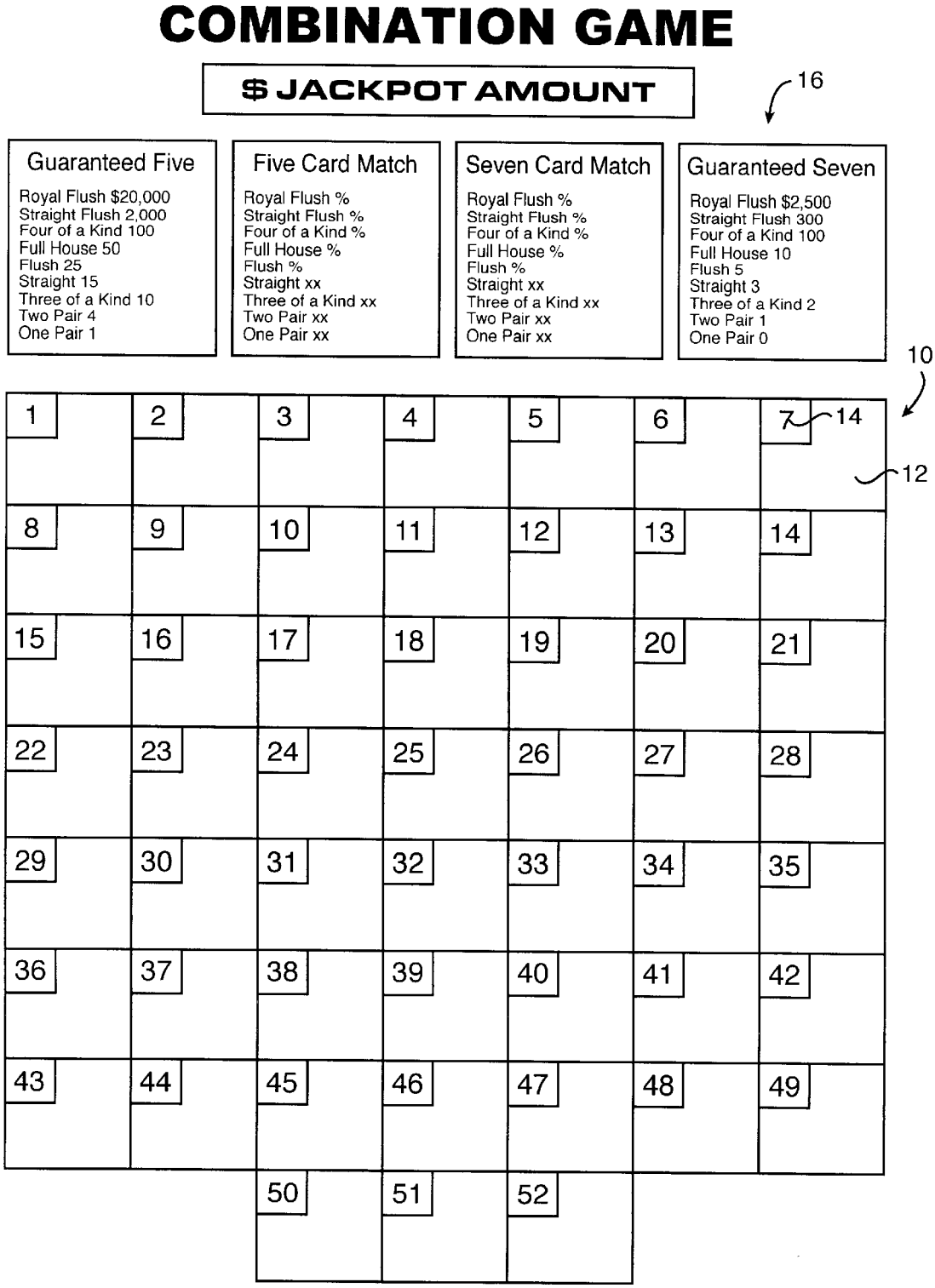
FIG. 1 is a drawing of an example display of the present invention.

The card game of the present invention provides a game based on a card game where only minimal knowledge of the rules of the underlying card game is necessary to play. The game is played with a set of basic rules and includes a number of optional enhancements. The basic game is that a player chooses a predetermined number of cards from an available set of cards, and uses the randomly selected values corresponding to those chosen cards to play a number of different individual games, or rounds, where a wager may be placed on each round.

The term "card" is used in the present application to indicate a playing card or any facsimile thereof. For example, a card can be a paper playing card, an image of a card on a video display, or an image of a card on a scratch ticket. Any representation of a playing card is contemplated. In addition, each card has a value which, for the standard poker decks of 52 cards, includes the suit (hearts, diamonds, clubs, spades) and the number (2–10,J,Q,K,A).

A game has at least two rounds. A player may play one or more rounds. There is no requirement that the player must play an earlier round in order to play a later round. For example, the player may play round three without having played round one or two. In a preferred embodiment, the game has four rounds. The first round is a five card match game, the second round is a seven card match game, the third round is a guaranteed five card hand game, and the fourth round is a guaranteed seven card hand game. This is but one way in which the individual games are ordered. The present invention contemplates that the individual games may be in any order. The rules of each individual game are described below, as if the individual game is played as an independent game, followed by how the individual games are combined to form the combination game.

As described below, winning hands are determined by poker hand rankings. The typical poker hand has five or seven cards, as in five card draw or five or seven card stud. However, many kinds of poker-type games can be used with the present invention, the commonality between the games being is that the winning hands are determined using poker rankings. For example, the hand can be as simple as a single card ("high-card"). Or the hand may be a shortened version where the hand has three cards. Or the hand may be more complex than a standard poker hand, where the hand has more than five cards and the best five card values are used to determine its winning status. 7-card stud is an example of the latter, however, a game may be chosen that uses more than seven cards. Finally, the hand may have more than five cards, where any subset of the cards may be used to determine its winning status.

The use of standard poker rankings to determine the whether or not the hand is a winner is merely a convenience. It is used primarily because most people know the rankings and know that it is more difficult to get a straight than to get a pair. However, other card combinations are contemplated for determining winning hands, for example, a hand of all even numbered cards or a hand with at least one card from each suit. It is also contemplated that Jokers and/or wild cards may be used. It is also contemplated that games other than poker may be played. One example is a game where the sum of the cards must be less than or greater than a certain number to win. It is also contemplated that decks of cards other than the standard 52-card poker deck may be used, for example, a deck of cards of other than 52 cards and/or with different symbols. Unless otherwise indicated, the remainder of the specification assumes that the games are based upon poker hands.

When wagering on the game, the amount of payouts is typically determined by the odds of getting a particular hand. There are several ways to determine how much is paid out for a particular hand. In one, the player receives a set multiple of the amount that the player originally wagered. For example, if a player gets a full house, she receives 50 times the amount that she wagered. In another method, the player receives a percentage of a jackpot that is a percentage of wagers by all of the players for that game and/or round. For example, if a player gets a straight flush, she received 40% of the jackpot. The third method is similar to the second, except that the percentage is taken from a cumulative jackpot, which an accumulation of some percentage of the wagers from the previous games. Finally, non-monetary winnings are possible, such as toys, gifts, or coupons. Each game may use only one method or various combinations of methods.

The individual games and the combination game have two types of actors, the player and the controller. The player is the person wagering on the outcome of the game and makes choices that influence that outcome. The terms "choose", "chosen", and "choice" are used in the present specification to refer to player actions and results. The controller is the entity, typically a computer, that makes random selections to which the player's choices are compared. The terms "select" and "selections" are used in the present specification to refer to game controller actions and results.

Prior to or during the game, the player chooses which rounds and cards to play. How the player chooses the rounds and cards depends upon the medium on which the game is played, and are described in detail below. All forms of media are contemplated, including public video and private video on local or wide-area networks, and standalone machines, including hand-held machines and personal computers.

Several methods for the player to choose cards are contemplated by the present invention. As an initial matter, the player does not know the value of the cards that are being chosen. The player is merely picking the appropriate number of cards of unknown value from a deck.

In the first method for choosing cards, illustrated in FIG. 1, the player chooses the cards from a displayed grid 10 of locations 12, where each card available to be chosen is represented by a grid location 12. The grid 10 may exist on, for example, a video screen or a paper ticket. Typically, there will be 52 locations representing the number of cards in a standard 52-card poker deck of playing cards. Alternatively, fewer or more locations 12 may be displayed if a card set other than the standard 52-card deck is used. Optionally, each location 12 is denoted by a unique symbol 14, for example the numerals 1–52. In the second method, the player chooses cards from a displayed list of unique symbols, such as the numerals 1–52, rather than from a grid. In a third method, no grid or list is displayed, but the player chooses from another medium, for example, a keyboard with a key for each possible card or a keypad with the numerals 0–9. In a fourth method, the player makes a "quick pick," that is, the player does not herself choose the individual cards, but instructs the controller to randomly choose the cards. The remainder of the specification assumes that the player uses the grid location method to choose cards.

The cards chosen by the player may be displayed in some manner so that the player receives feedback as to which cards are chosen. In one method, illustrated in FIG. 2, the chosen cards are shown by diagonal lines 22. Please note that if the display is intended to be viewed by more than one person, the chosen cards will most likely not be shown, as it may cause confusion among the several players. Alternatively, different color backgrounds may be used to distinguish between the chosen cards of several players, although problems associated with more than one player choosing the same card may limit the usefulness of this method. In another method, illustrated in FIG. 3, the unique symbols 14 representing the chosen cards are displayed in a secondary grid 26 next to the primary grid 10. Optionally, the chosen cards may be shown on the primary grid 10 by, for example, diagonal lines 28. In a third method, most suited for when a paper ticket is used to choose cards, a paper receipt listing the chosen cards is issued to the player. All of these methods are preferred, and the present invention contemplates that any other method of providing feedback to the player can be employed.

The present invention contemplates several methods for indicating the cards and corresponding card values randomly selected by the controller. In the first method, illustrated in FIG. 2, the selected cards and corresponding values are indicated by displaying the corresponding values in the selected card locations 12, as at 20 in FIG. 2. In the second method, illustrated in FIG. 3, the selected cards are not directly indicated, but the values corresponding to the selected cards are displayed in the secondary grid 26, as at 56.

The display may include textual information 16, such as the payout schedule for each round, the rules for each round and the game, the odds for each round, etc.

Figure 3:
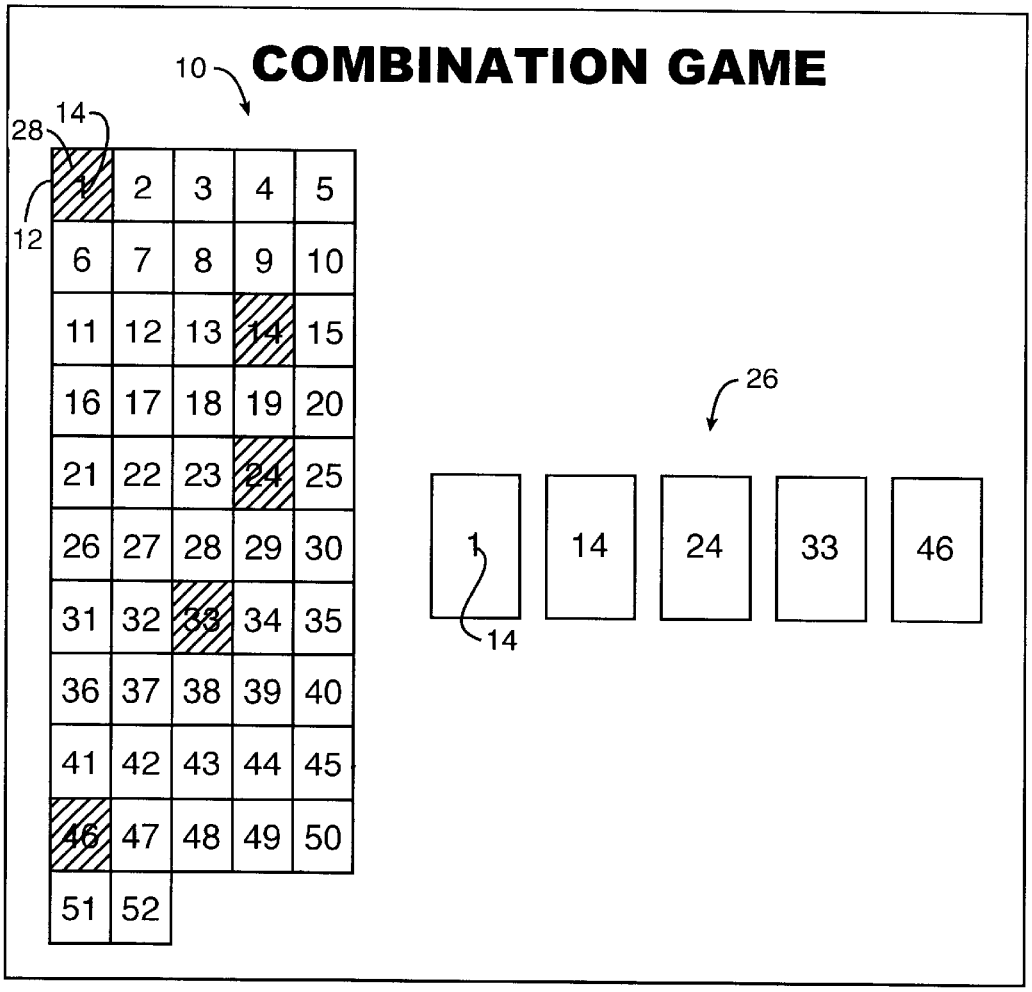
FIG. 3 is a drawing of another example display of the present invention showing five cards chosen by a player.

Unless otherwise indicated, any references to the display in the remainder of the present specification refer to any form of display that conveys the information discussed, although only displays based on the display of FIGS. 1 and 3 are specifically shown.

Five Card Match

The basic goal of the five card match game is for the player to choose the five cards on the 52-card grid that she thinks will be selected by the controller. The five card match game begins with the player choosing the five cards that she believes will be selected by the controller. Then the controller randomly selects and indicates a predetermined number of cards on the grid and, optionally, reveals the values that correspond to those cards. The random selection can occur at any time prior to the selected cards being indicated, including prior to the time the player makes her card choices. Payouts are made based on the number of matched cards, which are the chosen cards, not the values of the cards, that are the same as the selected cards. Payouts may also be made based on how the hand formed from the card values of the matched cards compares to a payout schedule. For example, if the game is poker, the payout schedule may indicate that the player will receive a payout for having a full house. Typically, a minimum of two matched cards are needed to participate in the poker hand. Alternatively, a single matched card may participate in the poker hand. Other games may have different minimum numbers of matched cards needed to participate in this phase of the game.

Seven Card Match

The seven card match game is very similar to the five card match game. The difference is that the player chooses seven cards, rather than five, on the grid that she thinks will be selected by the controller. Then the controller randomly selects and indicates a predetermined number of cards on the grid and, optionally, reveals the values that correspond to those cards. Alternatively, the player chooses five cards and the controller selects and indicates seven cards, or the player chooses seven cards and the controller selects and indicates five cards. As with the five card match game, the random selection can occur at any time prior to the selected cards being indicated, including prior to the time the player makes her card choices. Payouts are made based on the number of matched cards, which are the chosen cards, not the values of the cards, that are the same as the selected cards. Payouts may also be made based on how the hand formed from the card values of the matched cards compares to a payout schedule. For example, if the game is poker, the best five card values may be used to form a hand for comparison.

The present invention also contemplates that the five card and seven card match games described above may be modified so that the player chooses a different number of cards than the name of the game suggests and/or the controller selects a different number of cards than the name of the game suggests.

Guaranteed Five Card Hand

The basic goal of the guaranteed five card hand game is for the player to choose five cards to form a hand that is listed on the payout schedule. The guaranteed five card hand game begins with the player choosing the five cards that she believes, after the values for those cards are revealed, will have a listed hand. Then the controller randomly selects and reveals the card values for at least all of the player-chosen cards. Again, the random selection can occur at any time prior to the card values being revealed. Alternatively, and if the display permits, the values for all 52 cards are revealed. Payouts are based on how the hand formed from the values of the chosen cards compares to the payout schedule. In one embodiment, the player must use the five cards chosen, like in stud poker. In another embodiment, the game is played like draw poker, where the player is allowed to reject chosen cards and choose others to total five cards. If the values for all of the cards were previously revealed, then the values are again randomly selected and revealed for all rejected and newly chosen cards, leaving out the rejected cards. If only the chosen card values were revealed, there is no need to select values again, but to merely reveal the card values for the newly-chosen cards. It is also contemplated that this individual game may be played as a secondary bonus to another game.

Guaranteed Seven Card Hand

The guaranteed seven card hand game is very similar to the guaranteed five card hand game. The guaranteed seven card hand game begins with the player choosing the seven cards that she believes, after the values for those cards are revealed, will have a listed hand. Then the controller randomly selects and reveals the card values for at least all of the player-chosen cards. Alternatively, and if the display permits, the values for all 52 cards are revealed. Payouts are based on how the hand formed from the values of the chosen cards compares to the payout schedule. The same two embodiments as the guaranteed five card hand game, the stud-poker-like embodiment and the draw-poker-like embodiment, are contemplated for the guaranteed seven card hand game. Like the guaranteed five card hand game, it is also contemplated that this individual game may be played as a secondary bonus to another game.

Like the match games, the present invention also contemplates that the guaranteed five and guaranteed seven card hand games described above may be modified so that the player chooses a different number of cards than the name of the game suggests and/or the controller selects a different number of cards than the name of the game suggests.

The Combination Game

In the combination game of the present invention, two, three, or all four of the above-described individual games, or rounds, are combined into a single game.

Before game play begins, the house determines the exact rules of the combination game, including such items as which individual game is played in each round, the number of cards to match, how many cards are in a hand, the amount that can be wagered, the payout schedule, and any other rules necessary to playing the game. As indicated above, in one embodiment, the order of rounds is the five card match game, the seven card match game, the guaranteed five card hand game, and the guaranteed seven card hand game. The present invention also contemplates that the individual games may be played in any order. In the remainder of this description, the above-described order and poker rules for the individual games are assumed.

The game begins with the player choosing which rounds she will participate in, which cards to play for each round, and, optionally, the amount to wager for each chosen round. The number of cards that are chosen depends upon which rounds are played and whether the same chosen cards must be played for all rounds or different cards may be played for each round. In a simple example, the player chooses only rounds one and three and then chooses five cards that are played for both rounds. In a more complicated example, the player chooses all four rounds and different cards for each round. How rounds and cards are chosen is described below.

Figure 5:
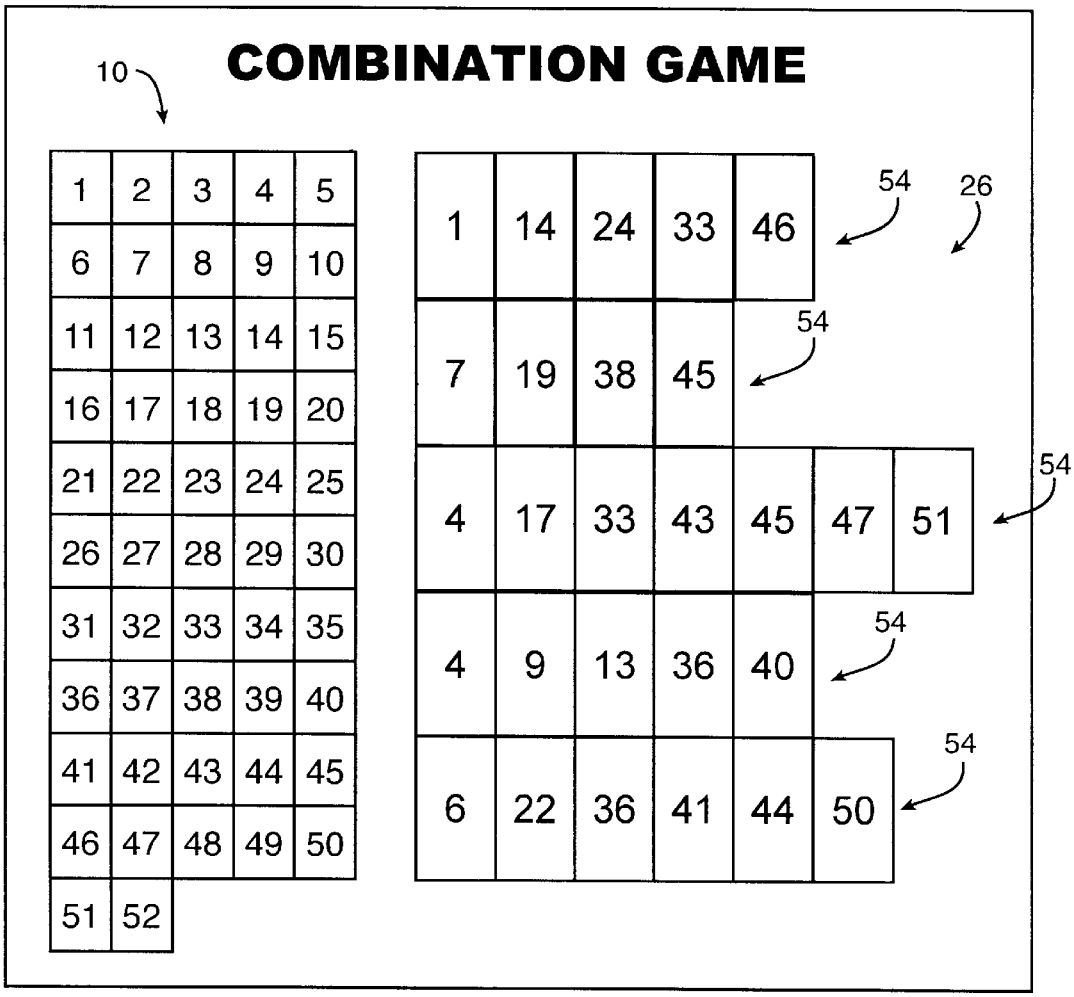
FIG. 5 is a drawing of configuration of the display of FIG. 3 where the player is playing five hands of different numbers of cards for a single game.

The present invention contemplates that a single player may play more than one hand during a single game, where each hand is independent of the others. For example, in the display of FIG. 5, the secondary grid 26 will display up to five hands 54 that are played during a single game. The player chooses the cards for the first hand and then is given a choice as to whether to play another hand. This continues until the maximum number of hands is reached. It is also contemplated that a different number of cards may be chosen for each hand of the same game, as shown by the differing numbers of cards in the hands 54 of FIG. 5.

Typically, after the cards are chosen, the player will wager on the outcome of the game. Wagering may not occur when the game is being played strictly for fun, such as a hand held video game or as a game in a game arcade. Any manner in which the player can make a wager is contemplated by the present invention where the possibilities are dictated by the media on which the game is played. Methods of indicating the amount of wagering are described below with reference to the various playing media.

The timing of the choices depends upon the manner in which the game is played. There are two basic forms. In the first, the timing is controlled by the players where the choosing process is not complete until all participating players have made their choices. An example of this timing is where the player is playing at a standalone machine in a casino. In the second, the timing is controlled by a clock where each game begins at a fixed time, and all players participating in a game must have their choices made prior to that time. An example of this timing is where the player is playing a public state-run game at one of numerous parlors throughout the state.

At the appropriate time, the five card match game is initiated and, assuming that all player choices have been made, five cards and their corresponding values are randomly selected and revealed. The actual timing of when the cards and values are randomly selected is not important. Since the cards and values are not revealed to the players until the appropriate time during each round, they may be randomly selected at any time prior to being revealed. In the example display of FIG. 2, the player-chosen cards 18 are indicated by left-to-right diagonals and the randomly-selected cards 20 are indicated by revealed card values in the corresponding card locations. Typically, if the grid 10 is intended to be viewed by more than one player, the player-chosen 18 cards are not shown on the grid. However, if the grid is intended to be viewed by only one player, the player-chosen cards 18 may be indicated in some manner, such as by a different colored background. Note that in the example of FIG. 2, there are three matched cards 22, that is, the player chose three cards that were also randomly selected, and the three-card hand formed by the matched cards 22 include one pair.

Figure 4:
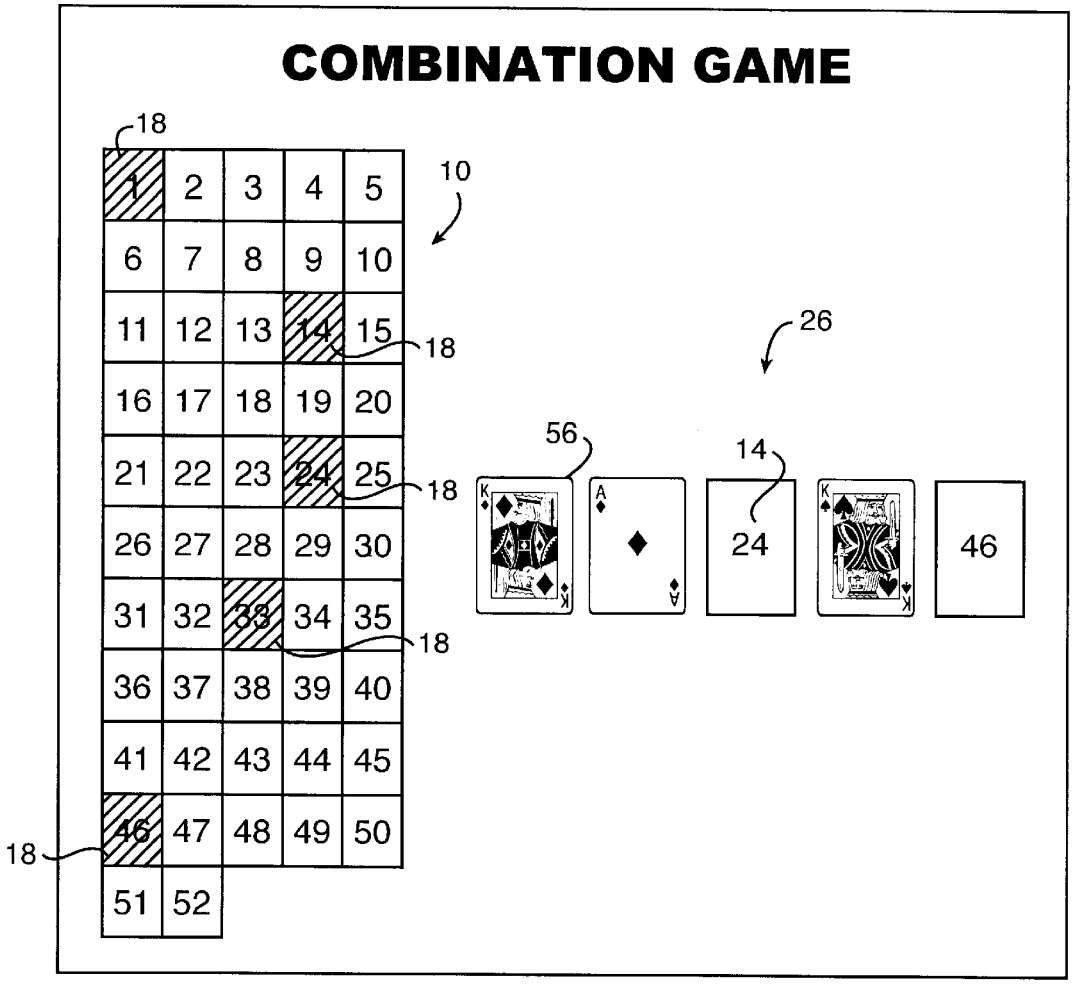
FIG. 4 is a drawing of the display of FIG. 3 showing cards chosen by a player and cards selected by the controller.

In the example display of FIG. 4, the player-chosen cards 18 are indicated by showing the card numerals 14 in the secondary grid 26 and the randomly-selected cards and corresponding values are shown by revealing the values 56 on the secondary grid 26. Any card on the secondary grid 26 that was not randomly selected retains the unique numeral 14 from the primary grid 10.

At this time, the game may be suspended so that payouts based on the number of matched cards and/or the payout schedule for the resulting hand can be made to the appropriate players. Alternatively, payouts are held until the end of the game, when payouts for all of the rounds are made at the same time.

Next, the seven card match game is initiated by randomly selecting and indicating two more cards and revealing their corresponding values. These two new cards plus the five cards from the five card match game are the seven cards used to determine matched cards. In FIG. 6, the new player-chosen locations 24 are indicated by right-to-left diagonals. Note also that there are now five matched cards and the hand formed by the matched card values includes two pairs. Like the first round, either the game is suspended and payouts made, or the payouts are held until the end of the game.

Figure 8:
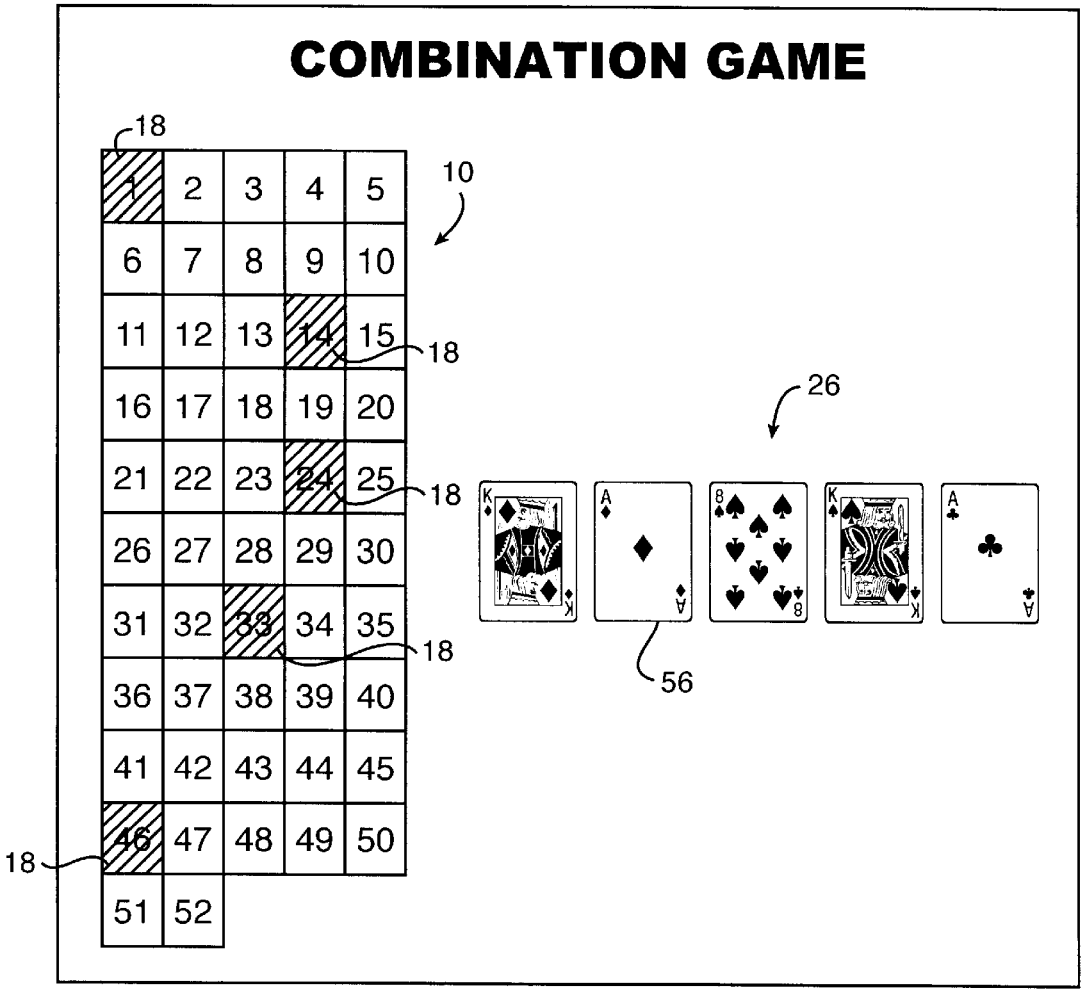
FIG. 8 is an example of the guaranteed five card hand game of the display of FIG. 3.

Next, the guaranteed five card hand game is initiated by randomly selecting and revealing the card values corresponding to the remainder of the cards, as in FIGS. 7 and 8. The card values revealed in the previous two rounds carry over to this round. Note that in the example of FIGS. 7 and 8, the hand formed by the five player-chosen card values includes two pair. Alternatively, as described above with reference to the individual guaranteed five card hand game, only the values 56 of the player-chosen cards 18 are revealed. At this time, any draw-poker-type actions are initiated, if allowed by the rules. Again, either the game is suspended and payouts made, or the payouts are held until the end of the game.

Finally, the guaranteed seven card hand game is played, as in FIG. 9. The card values selected and revealed in the previous rounds carry over to this round. Note that in the example of FIG. 9, the hand formed by the seven player-chosen card values includes a full house. Then payouts that have not yet been made, for both the guaranteed seven card hand game and the payouts from the previous rounds that were held until the end of the game, are made.

As indicated above, the appropriate cards and corresponding card values are revealed at the beginning of each round, in progression as each game is played. It is also contemplated that all of the cards and values are revealed at the same time. The advantage to revealing cards and values in progression is that the suspense of the game is enhanced because of the extended time over which the game is played. The advantage to revealing all of the cards and values at once is that the game is over more quickly and more games can be played during a given period of time. Finally, the present invention contemplates a hybrid, that is for example, all of the cards and values for the first two rounds are revealed and then all of the cards and values for the last two rounds are revealed at a later time.

Playing Medium

As indicated above, the present invention contemplates that the game may be played on a variety of media, including scratch or pull-tab tickets and electronic media, such as public systems and stand-alone machines.

Figure 10:
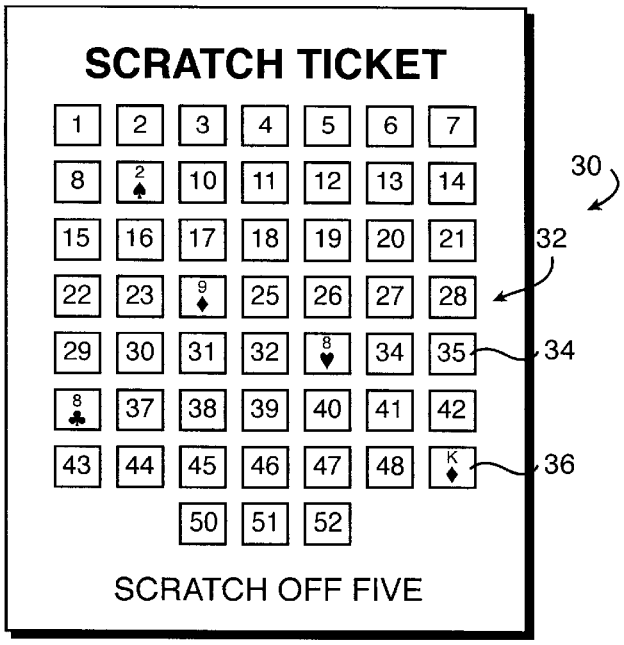
FIG. 10 shows a scratch ticket embodying the present invention.

With scratch tickets 30 or pull-tab tickets, as shown in FIG. 10, the card grid 32 is printed on the ticket 30, where the random selection of values for each card 34 is made prior to printing. The player wagers by paying for a receiving the ticket. The player makes her choices by scratching the chosen cards 36 and comparing the resulting hand to the payout schedule that is typically printed on the back of the ticket 30.

Figure 11:
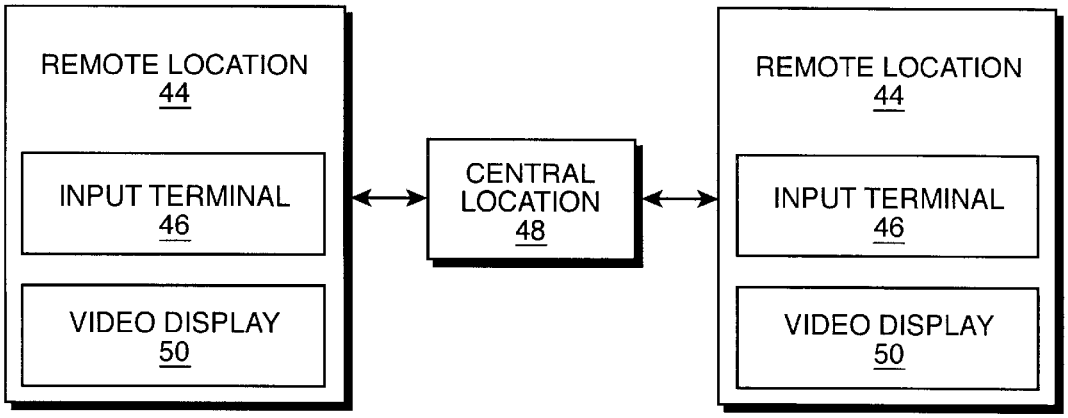
FIG. 11 is a block diagram of a public video system embodying the present invention.
Figure 12:
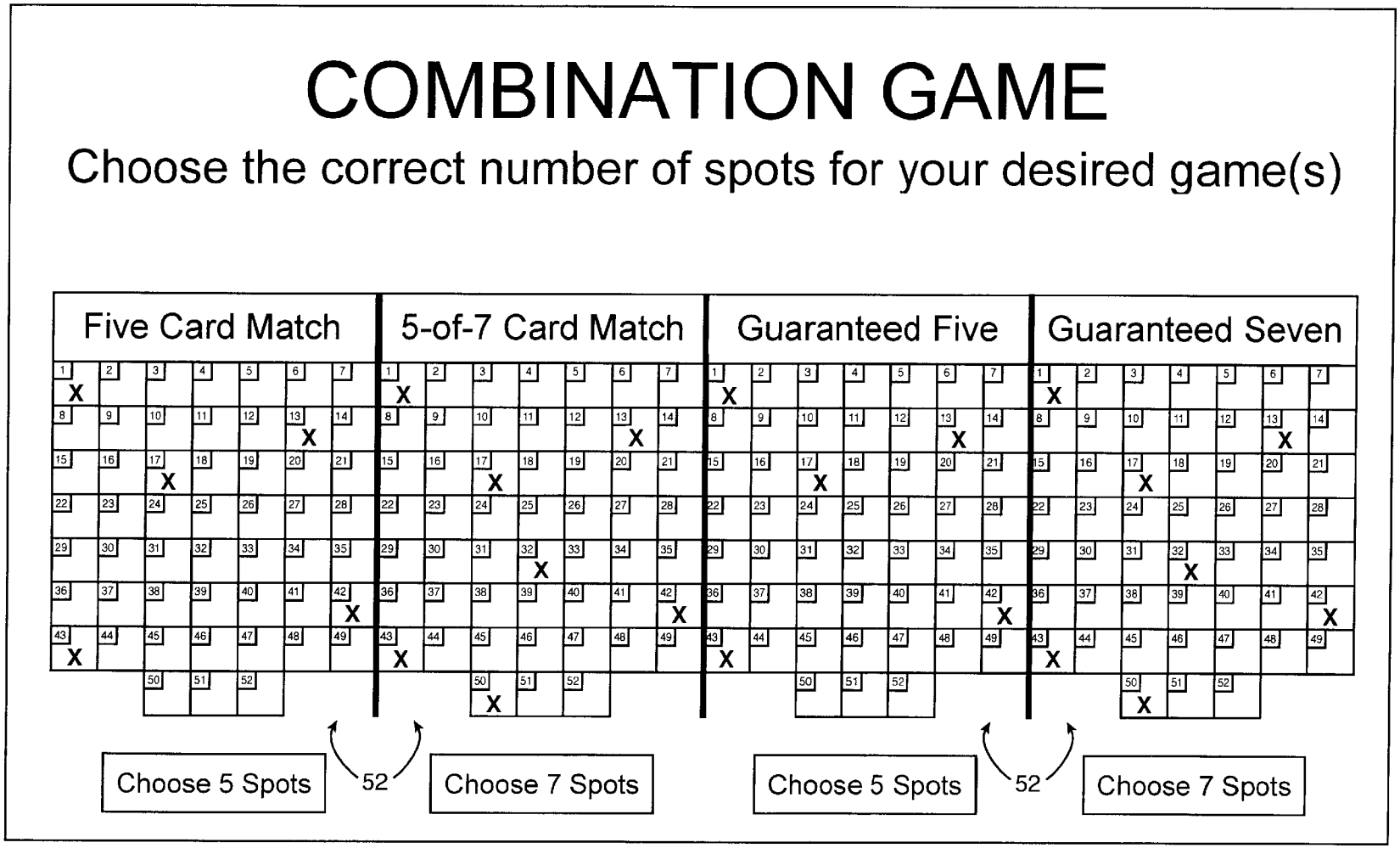
FIG. 12 is an example of a slip for choosing individual games and cards.

In public systems, a block diagram of which is shown in FIG. 11, a player typically make her choice at a remote location 44 by marking a slip of paper that is given to a clerk with the amount of the wager in cash. The slip is then scanned into a terminal 46 that sends the choices to a central location 48. Two examples of such a slip 40, 42 are shown in FIGS. 12 and 13. The player chooses rounds by marking cards in the grids 52 associated with the chosen rounds. Alternatively, choices can be made by keys on a keyboard, keys on a key grid, or by boxes on a touch screen grid. Alternatively, the player may request a "quick pick," where the system randomly chooses cards for the player. The player receives a receipt, such as a paper receipt, or other acknowledgement, such as an indication on a private terminal, indicating the cards chosen for each round. The grid is displayed on a video screen 50 or matrix of video screens visible to the players at the remote location 44 from information received from the central location 48.

Figure 14:
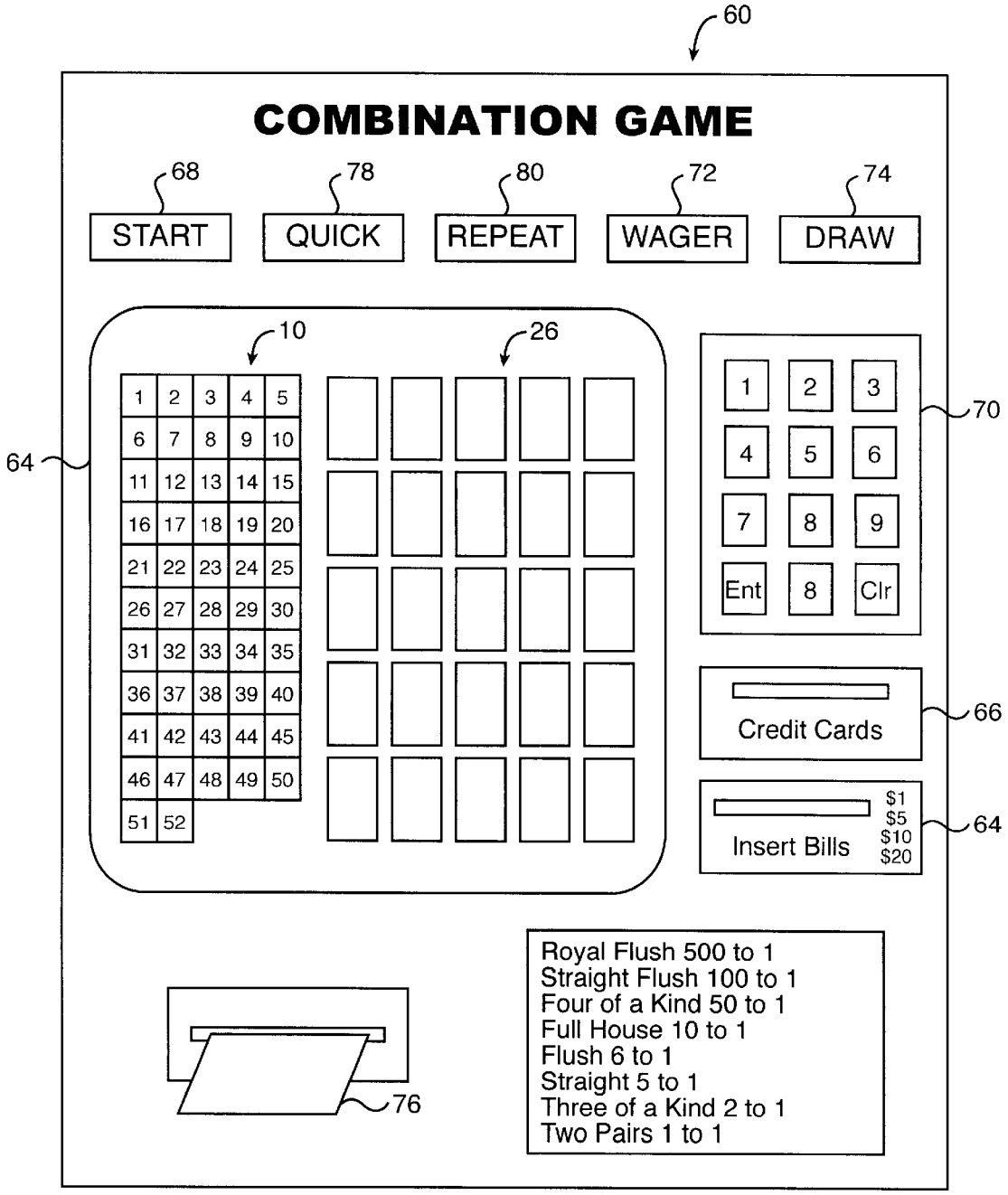
FIG. 14 is an example of a standalone machine embodying the display of FIG. 3.

With standalone machines, an example of which is shown in FIG. 14 implementing the display of FIG. 3, each player has her own terminal 60. An example is a video machine at a gaming establishment. The primary grid 10 and secondary grid 26 are displayed on the player's video screen 62. Prior to playing any game, the player inserts cash into a money reader 64 or swipes a credit or debit card in a card reader 66. The player begins a game by pressing the START button 68 and entering her card choices by keypad 70 or the primary grid 10. After the cards are chosen, the player presses the WAGER button 72 and indicates the amount to wager for the game. This can be done in any of several ways. One way is for the player to indicate the amount of wager on the keypad 70. Another way, and one that is unique to the present invention, is to input the amount of wager on the primary grid 10 by pressing the card button corresponding to the amount of the wager, for example, the "20" card for a wager of $20. After the wager is made, the player presses the DRAW button 74 to complete the game. Winning amounts are credited to the player and may be printed on a voucher 76 for payment by a cashier or they may be paid in coins or other monetary tokens by the terminal itself. Optionally, the terminal 60 may include a QUICK button 78 to provide the player with a "quick pick" option, and/or a REPEAT button 80 so that the player may repeat the card choices from the previous game.

Alternatively, the standalone machine may be a personal computer on a network. Wagers can be made by debits to credit cards or debit cards or other cash equivalent, and payouts may be made by crediting credit or debit cards or other bank account.

The information transfer between the remote and central locations can occur on any communications system, including local-area and wide-area networks. In local-area networks, the remote locations and central location are in close proximity to each other, such as in a single building or building complex, and are typically wired directly together. In wide-area networks, there is generally no limitation to how far the locations are from each other. Communication typically occurs over private leased telephone lines or public lines such as Internet connections. In some cases, the communication is wireless. In other cases, communication is over television cables.

Thus it has been shown and described a multiple round card game of chance which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A method of playing a card game with a set of cards, said method comprising the steps of:

(a) providing a plurality of game rounds and unique rules for each of said rounds;

(b) randomly selecting a unique card value for each card;

(c) allowing a player to choose to play at least one of said rounds as chosen rounds;

(d) allowing said player to choose a predetermined number of said cards as chosen cards for each of said chosen rounds;

(e) revealing said card values for at least a portion of said chosen cards according to said rules;

(f) forming a hand for each of said chosen rounds from said card values of said at least a portion of said chosen cards according to said rules; and (g) comparing said hand to a set of winning hands for each of said rounds.

2. The method of playing a card game of claim 1 wherein said method includes providing a grid having a location for each of said cards, and allowing said player to choose said chosen cards from said grid.

3. The method of playing a card game of claim 1 wherein said method includes displaying said chosen cards on a secondary grid.

4. The method of playing a card game of claim 1 wherein said method includes providing the ability for said player to replay said chosen cards from a previous game.

5. The method of playing a card game of claim 1 wherein said method includes providing the ability for said player to randomly choose said chosen cards.

6. The method of playing a card game of claim 1 wherein said method includes revealing said card values on a secondary grid.

7. The method of playing a card game of claim 1 wherein said method includes providing a payout schedule for said set of winning hands, allowing said player to wager on the outcome of each of said chosen rounds prior to revealing said card values for said each of said chosen rounds, and making payouts to said player after comparing said hand to said set of winning hands.

8. The method of playing a card game of claim 1 wherein said card values are revealed in progression for each of said rounds.

9. The method of playing a card game of claim 1 wherein said card values are revealed for all of said rounds at one time.

10. The method of playing a card game of claim 1 wherein one of said rounds comprises randomly selecting a predetermined number of said cards as selected cards, determining matched cards as being those of said chosen cards that are the same as said selected cards, and including in said payout schedule payouts based on the number of said matched cards.

11. The method of playing a card game of claim 10 wherein said payout schedule includes payouts for hands formed from said card values corresponding to said matched cards.

12. The method of playing a card game of claim 1 wherein one of said rounds comprises revealing said card values corresponding to at least all of said chosen cards and including in said payout schedule payouts for hands formed from said selected card values corresponding to said chosen cards.

13. A method of playing a card game with a set of cards, said method comprising the steps of:

(a) providing a plurality of game rounds, unique rules for each of said rounds, and a set of winning hands with a payout schedule;

(b) randomly selecting a unique card value for each card;

(c) allowing a player to choose to play at least one of said rounds as chosen rounds;

(d) allowing a player to wager on the outcome of each of said chosen rounds;

(e) providing a grid having a location for each card;

(f) allowing said player to choose from said grid a predetermined number of said cards as chosen cards for each of said chosen rounds;

(g) revealing said card values for at least a portion of said chosen cards according to said rules;

(h) forming a hand for each of said chosen rounds from said card values of said at least a portion of said chosen cards according to said rules; and (i) making payouts to said player based on a comparison of said hand to said set of winning hands.

14. The method of playing a card game of claim 13 wherein said method includes displaying said chosen cards on a secondary grid.

15. The method of playing a card game of claim 13 wherein said method includes revealing said card values on a secondary grid.

16. The method of playing a card game of claim 13 wherein said method includes providing the ability for said player to replay said chosen cards from a previous game.

17. The method of playing a card game of claim 13 wherein said method includes providing the ability for said player to randomly choose said chosen cards.

18. The method of playing a card game of claim 13 wherein said card values are revealed in progression for each of said rounds.

19. The method of playing a card game of claim 13 wherein said card values are revealed for all of said rounds at one time.

20. The method of playing a card game of claim 13 wherein one of said rounds comprises randomly selecting a predetermined number of said cards as selected cards, determining matched cards as being those of said chosen cards that are the same as said selected cards, and including in said payout schedule payouts based on the number of said matched cards.

21. The method of playing a card game of claim 20 wherein said payout schedule includes payouts for hands formed from said card values corresponding to said matched cards.

22. The method of playing a card game of claim 13 wherein one of said rounds comprises revealing said card values corresponding to at least all of said chosen cards and including in said payout schedule payouts for hands formed from said selected card values corresponding to said chosen cards.

* * * * *